United States Patent [19]

Leu

[11] 4,169,563

[45] Oct. 2, 1979

[54] THREAD DRAW-OFF DEVICE

[75] Inventor: Erwin Leu, Horgen, Switzerland

[73] Assignee: Maschinenfabrik Schweiter AG, Horgen, Switzerland

[21] Appl. No.: 956,108

[22] Filed: Oct. 30, 1978

[30] Foreign Application Priority Data

Nov. 9, 1977 [CH] Switzerland ..... 13686/77

[51] Int. Cl.[2] ..... B65H 54/22

[52] U.S. Cl. ..... 242/35.6 E; 15/256.52; 28/294

[58] Field of Search ..... 242/35.6 E, 35.6 R, 242/35.5 R, 35.5 A; 28/293, 294; 15/301, 256.52

[56] References Cited

U.S. PATENT DOCUMENTS

| | | | |
|---|---|---|---|
| 2,747,806 | 5/1956 | Borchardt | 242/35.5 A |
| 2,769,598 | 11/1956 | Drake et al. | 242/35.5 A |
| 3,096,946 | 7/1963 | Schweiter | 242/35.6 E |
| 3,377,031 | 4/1968 | Raasch et al. | 242/35.6 E |
| 3,464,640 | 9/1969 | Kupper | 242/35.6 E |
| 3,494,563 | 2/1970 | Kupper | 242/35.6 E |
| 3,866,848 | 2/1975 | Abbott | 242/35.6 E |

FOREIGN PATENT DOCUMENTS

| | | | |
|---|---|---|---|
| 37-5833 | 6/1962 | Japan | 242/35.6 R |
| 42-8740 | 4/1967 | Japan | 242/35.6 E |

*Primary Examiner*—Stanley N. Gilreath

*Attorney, Agent, or Firm*—Frishauf, Holtz, Goodman & Woodward

[57] ABSTRACT

There is disclosed a nozzle having a pair of rollers arranged at the end over a suction slot. A smooth contact roller of the pair is arranged toward the outside for contacting the surface of a wound thread member rotating against it. The other clamping roller is rotated by contact with the contact roller and spaced back from the wound thread member. The contact roller is movably mounted so that the contact pressure forces it into rolling contact also with the clamping roller. The clamping roller is a multiple worm roller, by which along the contact line of the two rollers there are a series of clamping points which tug at the thread as it is pulled into the nozzle by the suction through spaces separating the clamping points along the length of the rollers. The contact roller may be tapered to a smaller diameter toward the middle, with the clamping roller being correspondingly tapered to a larger diameter toward the middle. This reduces the rolling pressure against the wound thread member in that portion where the thread is most likely to be unwinding from it.

6 Claims, 3 Drawing Figures

THREAD DRAW-OFF DEVICE

BACKGROUND OF THE INVENTION

The present invention relates to a thread draw-off device for wound thread members, such as textile bobbins or a rotating cheese or cop, with a suction nozzle arranged level with the bobbin surface or which can be adjusted to the latter, whereby the suction nozzle is in flow connection with a suction source via connecting means.

It is already known in the case of such an arrangement to provide within the suction flow gripping members which periodically nip the thread and, during the nipping of the thread and the further rotation of the bobbin, detach the thread from the latter.

However, such gripping members require a relatively large amount of space at the winding point for the arrangement of control and drive means. There is also a risk of the thread breaking, thus requiring a repetition of the search and suction operation.

BRIEF SUMMARY OF THE INVENTION

The problem to which the present invention is directed is that of providing an arrangement of the above-described type which obviates disadvantages thereof and which is particularly suitable for fitting to existing winding machines or copping units without any significant effort or expenditure.

According to the present invention, within the slit-like suction opening of a suction nozzle there extend two rollers over at least approximately the entire width of the nozzle. One roller has a contact surface for engaging on the cheese surface and on the other roller, while the other roller has a circumferentially interrupted surface for producing intermittent clamping points with the contact roller.

Quite apart from the fact that such a suction nozzle can without difficulty be used for replacing an already existing suction nozzle on a winding machine or copping unit, it requires no additional control and drive means. Moreover it is not possible for the thread to part because the thread can now be drawn off at a speed corresponding to the thread winding-off speed.

An advantageous construction of the thread draw-off device is provided if the contact roller has a smooth surface and if the contact roller is freely supported in link plates, but slightly inclinable on the suction nozzle.

According to a further development, the other roller can be fixedly supported by bearing means on the suction nozzle wall, the other roller being a multiple worm roller.

To prevent any counterflow and obstruction, the thread draw-off device is further developed so that a flow gap is provided between the roller surfaces and the wall portions defining the suction part of the suction nozzle, with venting to the outside being in each case via ventilating slots.

DETAILED DESCRIPTION OF THE PREFERRED EMBODIMENTS

Figure 1:
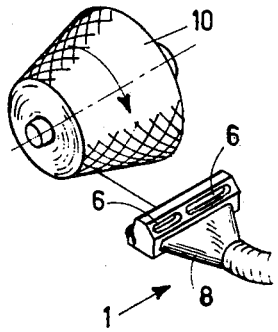
FIG. 1 is an elevated perspective view of a draw-off device in accordance with a preferred embodiment of the present invention shown drawing the end section of thread off a textile bobbin.

FIG. 1 shows a textile cheese 10 which rotates in the direction of the arrow for winding the thread onto a corresponding but not shown, winding device.

In the case of a thread break, or when the thread supplied is used up, it is necessary to raise the free thread end from a cheese 10 and pull it off somewhat in order to be able to join the end to the start of the thread in a thread reserve.

For this process the cheese 10 is rotated backwards, counter to the direction of the arrow, and a suction nozzle 1 can be appropriately adjusted to a thread draw-off device. For this purpose, mechanical control members hold the thread draw-off device, permitting a movement of it forward or away. The control members can be of various types and require no detailed explanation here. It is also readily apparent that suction nozzle 1 is in flow connection via a connecting piece 8 with an also not shown suction source.

Figure 2:
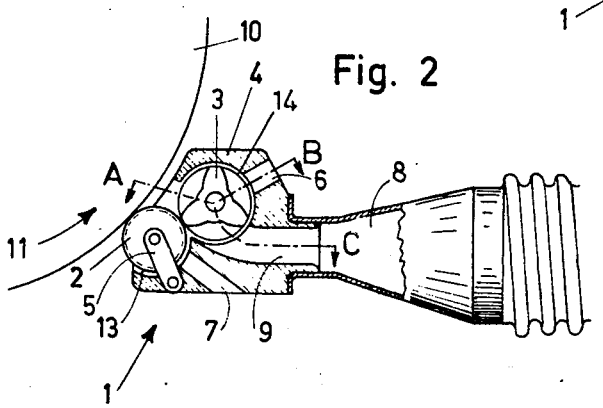
FIG. 2 is a partially sectioned side view of the draw-off device of FIG. 1 shown enlarged as compared to the illustration of the device in the FIG. 1.

FIG. 2 illustrates the above-described process in detail, suction nozzle 1 being adjusted to the winding surface of cheese 10. The rearward rotation of cheese 10 is indicated by arrow 11.

Figure 3:
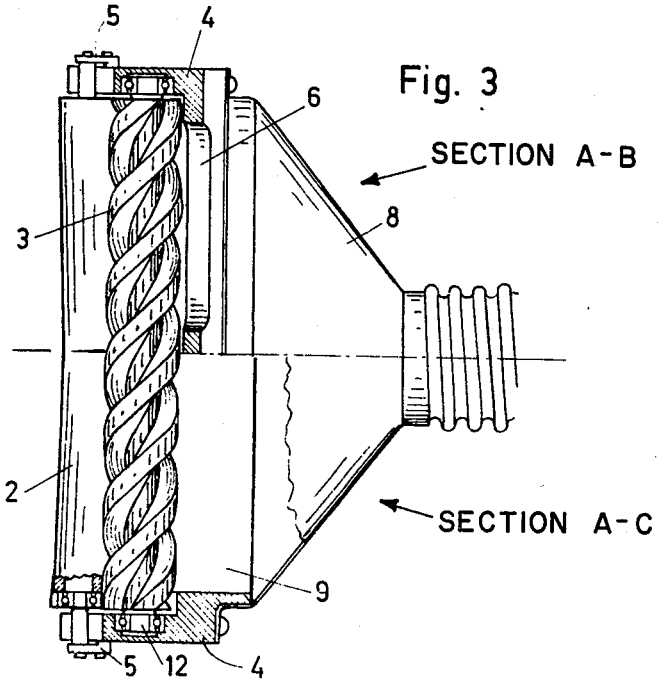
FIG. 3 is a partially sectioned top view of the draw-off device in FIGS. 1 and 2. The sectioning of the figure is indicated by line A-B and line A-C in FIG. 2 except that roller 3 is shown in full.

FIGS. 2 and 3 illustrate in detail the construction of suction nozzle 1 of the thread draw-off device according to the invention. In known manner, suction nozzle 1 has a predetermined width approximately corresponding to that of the cheese 10, so as to be able to cover the entire cheese width at once, for which purpose nozzle 1 naturally has a corresponding slit-like suction port.

In the suction port there are provided two rollers 2, 3 which extend over the entire width thereof. According to FIG. 2, roller 2 is somewhat below and in front of roller 3. Roller 2 has a smooth surface and is in contact with both the winding surface of cheese 10 and roller 3 in order to transmit the rotary movement from cheese 10 to roller 3. For this purpose, contact roller 2 is supported freely in link plates 5, but slightly tiltable on suction nozzle 1 and projects somewhat out of the suction port, as can be gathered from FIG. 2. However, roller 3 is fixedly supported via ball bearing 12 on the wall 4 of nozzle 1 and is located immediately in front of suction duct 9 issuing into the suction port. Roller 3 also has a circumferentially interrupted surface, which preferably forms a multiple worm, as can be gathered from FIGS. 2 and 3. A flow gap 13, 14 is provided between the roller surfaces and the wall portions of suction nozzle 1 defining the suction port, with each gap venting to the outside via a ventilating slot 7, 6 extending over the entire nozzle width. These measures prevent a vacuum in the gap 13, 14 from winding the thread around one or other roller and/or a corresponding counterflow. Obstructions by loose thread ends are also prevented.

For receiving and sucking in a thread end from the winding surface of the cheese, the latter slowly rotates, as indicated hereinbefore, in the direction of arrow 11 and the thread draw-off device is adjusted to the cheese 10 until contact roller 2 engages both on the cheese and on the worm roller 3. This leads to a rotation of rollers 2 and 3 which transports a thread located between the same into suction nozzle 1. If the thread end is now raised from the cheese surface by the suction air flow and sucked between the two rollers, the clamping points formed by the engagement contact of the faces of worm roller 3 with the smooth contact roller 2 grip the thread and unwind it into the nozzle 1. Due to the rotation of worm roller 3, the thread is plucked intermittently, and this detaches the thread from the cheese surface in a particularly reliable manner as compared with prior art methods. The thread cannot part, because the plucking takes place through the contact drive at a speed corresponding to the unwinding of the thread. It is also unimportant at what point on the cheese the thread is raised, because the rollers extend over the entire cheese width and act at all points.

It is particularly advantageous if, as can be gathered from FIG. 3, contact roller 2 is conically tapered from both ends to a smaller diameter at the centre. Thus, a small air gap is formed between the cheese surface and the contact roller, so that on applying roller 2 the thread end is no longer pressed into the bobbin.

As a function of the concave configuration of contact roller 2, worm roller 3 is made convex to corresponding degree to maintain the clamping action between both rollers.

I claim:

1. A device for drawing the free thread end from a wound thread member, such as a bobbin, cop, or cheese, the device being of the type in which a suction nozzle connected to a suction source is moved into engagement with the rotating wound thread member to pull the thread end from the wound thread member into the nozzle, the improved nozzle therein comprising:

a nozzle housing having an inner suction passageway leading to a suction slot which opens to the exterior, an elongated contact roller mounted on said housing at least partially in said suction slot so that it can be rotated by a movement of the wound thread member rotating against it and can have its position shifted toward the inside of the housing by the pressure of its contact with the wound thread member, and an elongated clamping roller mounted in said suction slot with its axis substantially parallel to that of said contact roller and spaced back from said contact roller toward the inside of said housing so that it does not come in contact with the wound thread member, said clamping roller being rotated by said contact roller and having a circumferentially interrupted surface which in cooperation with said contact roller produces intermittent thread clamping points between said contact and said clamping rollers along said suction slot.

2. The device of claim 1 and wherein said contact roller has a smooth surface.

3. The device of claim 1 and wherein said contact roller is supported freely in link plates so that it can be slightly pivoted toward said clamping roller.

4. The device of claim 1 and wherein said clamping roller is rotatably supported by fixed end bearings in said housing.

5. The device of claim 1 and wherein said clamping roller is a multiple worm roller.

6. The device of claim 1 and wherein said housing comprises venting ports leading from the exterior of said housing to a gap formed between said housing and said contact roller and also between said housing and said clamping roller, for reducing suction in the gaps where they open to the exterior of said housing.

* * * * *